United States Patent [19]

Tasker

[11] 4,346,546

[45] Aug. 31, 1982

[54] AUTOMATIC FLEXIBLE CONTAINER FABRICATING MACHINE

[76] Inventor: Sidney Tasker, 853 N. Detroit St., Los Angeles, Calif. 90046

[21] Appl. No.: 172,067

[22] Filed: Jul. 24, 1980

Related U.S. Application Data

[63] Continuation of Ser. No. 951,716, Oct. 16, 1978, abandoned.

[51] Int. Cl.[3] ..... B65B 61/18; B65B 43/00

[52] U.S. Cl. ..... 53/412; 53/452; 53/133; 53/558; 53/567

[58] Field of Search ..... 53/451, 558, 562, 570, 53/567, 452, 459, 469, 481, 551, 554, 133, 412

[56] References Cited

U.S. PATENT DOCUMENTS

| | | | |
|---|---|---|---|
| 2,612,738 | 10/1952 | Salfisberg | 53/567 X |
| 2,861,406 | 11/1958 | Holsman et al. | 53/567 X |
| 3,234,069 | 2/1966 | Saas | 53/133 X |
| 3,269,087 | 8/1966 | Cloud et al. | 53/567 |
| 3,330,090 | 7/1967 | Court et al. | 53/570 X |
| 3,390,507 | 7/1968 | Repko | 53/412 |
| 3,481,102 | 12/1969 | Dolman | 53/570 X |
| 3,529,400 | 9/1970 | Takagaki | 53/567 |
| 3,579,948 | 5/1971 | Lerner | 53/570 X |
| 3,594,978 | 7/1971 | Spitznagel | 53/567 |
| 3,682,051 | 8/1972 | Sengewald | 53/562 X |
| 3,728,840 | 4/1973 | Izumi | 53/562 X |
| 3,948,015 | 4/1976 | Lerner | 53/570 X |

FOREIGN PATENT DOCUMENTS

| | | | |
|---|---|---|---|
| 1247191 | 9/1971 | United Kingdom | 53/567 |

*Primary Examiner*—Horace M. Culver
*Attorney, Agent, or Firm*—Herzig & Walsh Inc.

[57] ABSTRACT

An automatic or fully automated machine for fabricating flexible containers sometimes known as squeeze containers. The containers are fabricated from flexible plastic tube stock. The machine embodies stages or stations arranged in line at which operations are performed on the stock material, the final operation being the filling and sealing of the container. The stations include an initial heating station for producing the desired flexibility in the material. As the stock is advanced, an initial slit is made part way through the tubing. Initial sealing is performed at a further station which fabricates the discharge end of the container. The stock is advanced in steps. At a final station, the fabricated container is filled and sealed. All of the operations are automated and are sequenced by way of automatic, pneumatic, and electrical controls.

10 Claims, 25 Drawing Figures

172
92'
131
130
132
134
135
136
12
12
126
154
96'
137
16
150
120
162
152'
164
160
166
156
13
13
133
116"
116'
180
178
10
181
184
182
186
116"
116'
185

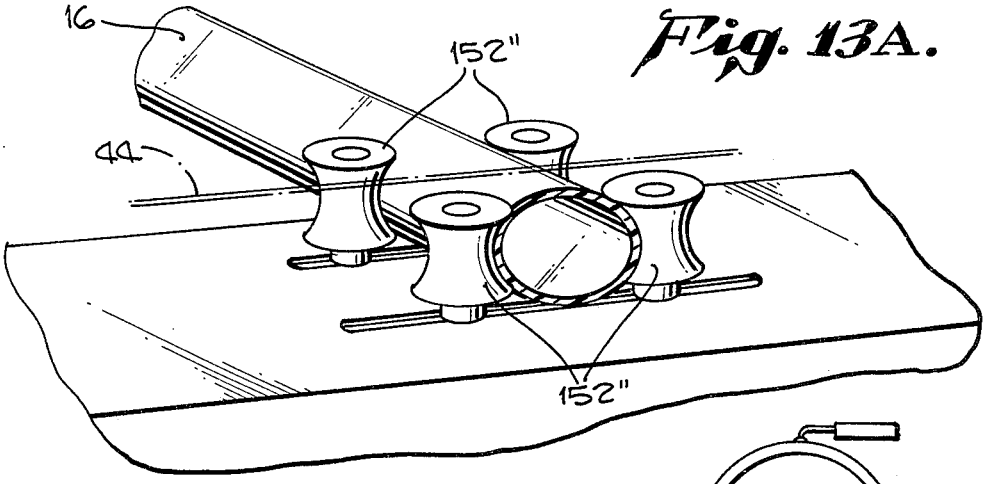
Fig. 13A.
Fig. 13B.
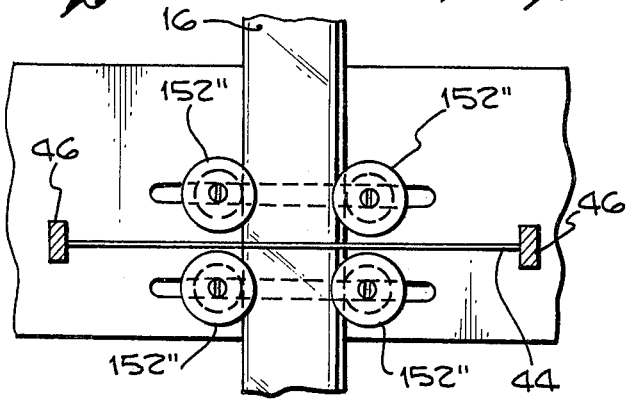
Fig. 19A.
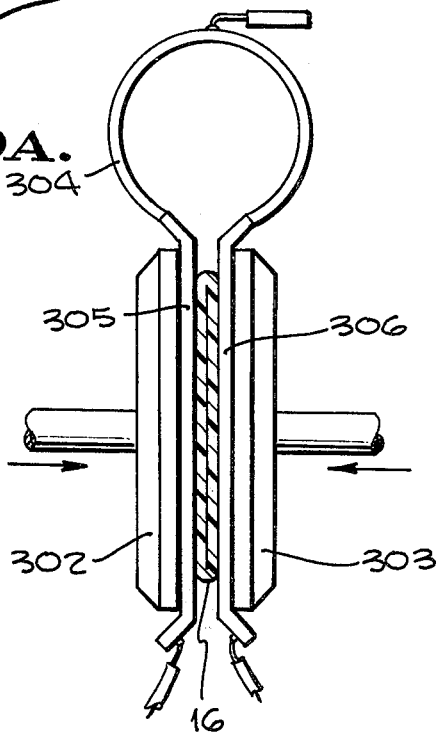
Fig. 13C.
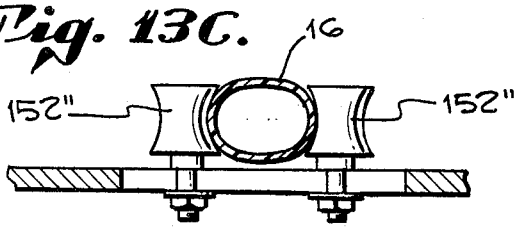
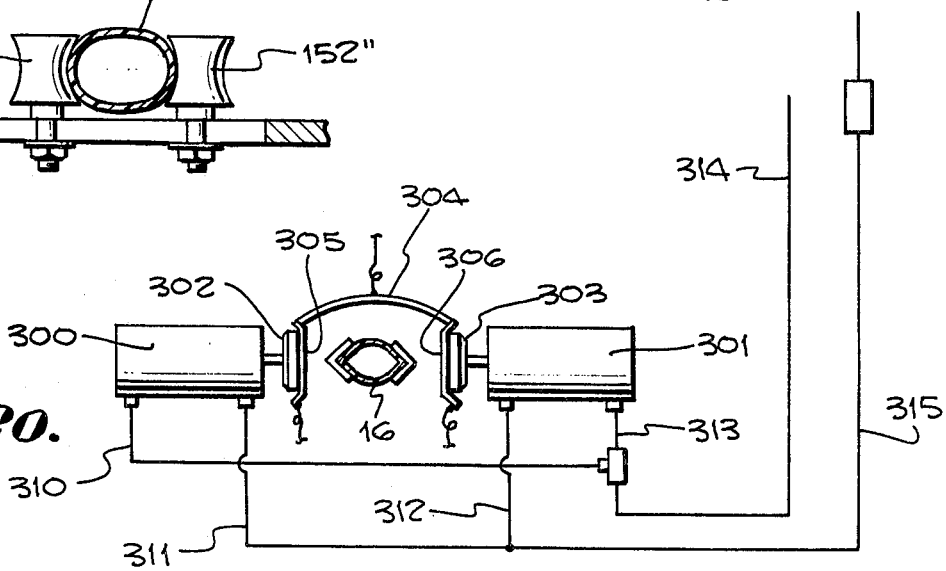
Fig. 20.

AUTOMATIC FLEXIBLE CONTAINER FABRICATING MACHINE

This is a continuation of application Ser. No. 951,716 filed on Oct. 16, 1978, and now abandoned.

BACKGROUND OF THE INVENTION

1. Field of the Invention

The field of the invention is concerned with flexible tubular containers commonly referred to as squeeze containers, and more particularly to apparatus and methods for fabricating such containers and filling and sealing them. The field of the invention is especially that of preferably fully automated equipment for fabricating containers of this type.

2. Description of the Prior Art

Flexible containers of the type referred to are known in the prior art. Typically such containers are tubular having a discharge end which may have a closure of various types. Such containers typically may be fabricated from tubular plastic stock. Usually the discharge end is fabricated by way of heat sealing of the sides of the material at the end of the container to provide a discharge pasageway and closure. Other than this part of the technology, teaching appears to be lacking in the prior art of apparatus, particularly automated apparatus and methods for fabricating containers of this type from stock originally in the form of a roll of flat or collapsed plastic tubing. Containers of the type referred to are used in very large quantities for various types of commercial materials, particularly cosmetics, for example. Accordingly, apparatus and methods for economically, effectively, and rapidly fabricating such containers represents a need in the art.

SUMMARY OF THE INVENTION

The apparatus of the invention in its exemplary form is a fully automatic or automated machine or equipment which receives tubular plastic stock material, as from a roll, and processes it at successive stations to completely fabricate individual plastic tubular containers, fills them, and performs a final closing, that is, sealing operation.

In the machine, the tubular stock material is typically advanced in steps with operations taking place at successive stages or stations in the fabricating sequence. The material goes through an initial heating chamber wherein the heat produces a desired degree of consistency and flexibility in the plastic stock material. The tube which is initially flat passes through a former to restore or expand it from the flat condition to facilitate the slitter's making a slit part way through the stock material. Air is blown into the tubing to facilitate slitting. An automatic heat sealer heat seals the end of the slit tube to provide the end discharge and closure means. The tubular material is advanced in successive steps or stages. After the heat sealing, a notcher may cut away part of the stock material adjacent to the heat sealed portions to fabricate the end part of the container. Finally, the fabricated container is loaded with its contents from one end after which that end is sealed to complete the fabrication.

In light of the foregoing, the primary object of the invention is to provide apparatus and a method which is fully automatic for the purpose of fabricating flexible tubular containers and to fill and seal them.

A further object is to provide apparatus and method as in the foregoing wherein the apparatus is fully automatic, under the control of automatic, pneumatic, and electrical control instrumentalities or the like.

Further objects and additional advantages of the invention will become apparent from the following detailed description and annexed drawings.

BRIEF DESCRIPTION OF THE DRAWINGS

FIG. 13A is a detailed perspective view of the former guide.

FIG. 13B is a top view thereof.

FIG. 13C is an end view thereof.

FIG. 19A is a plan view of a second embodiment of sealing means;

FIG. 20 is a fragmentary side section view of a preferred form of the pneumatic system;

DESCRIPTION OF THE PREFERRED EMBODIMENT

Figure 13:
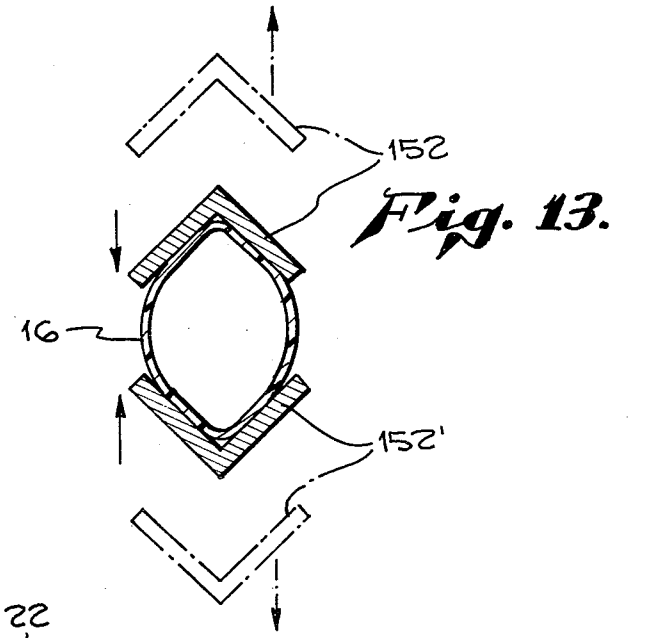
FIG. 13 is a sectional view taken along the line 13—13 of FIG. 11.

The machine includes a stand 10 and platform 11. At one end of a holder or support 14 for the roll of tubular stock material 16 which is rotatable around the shaft 17. The stock material passes under an idler pulley 18. Numeral 22 designates a heating chamber or tunnel having electrical heating means 24 in it through which the stock material passes traveling between spaced rollers 25. Heat is applied at a temperature sufficient to produce a desired flexibility or consistency of the stock material for further processing and fabrication.

Figure 4:
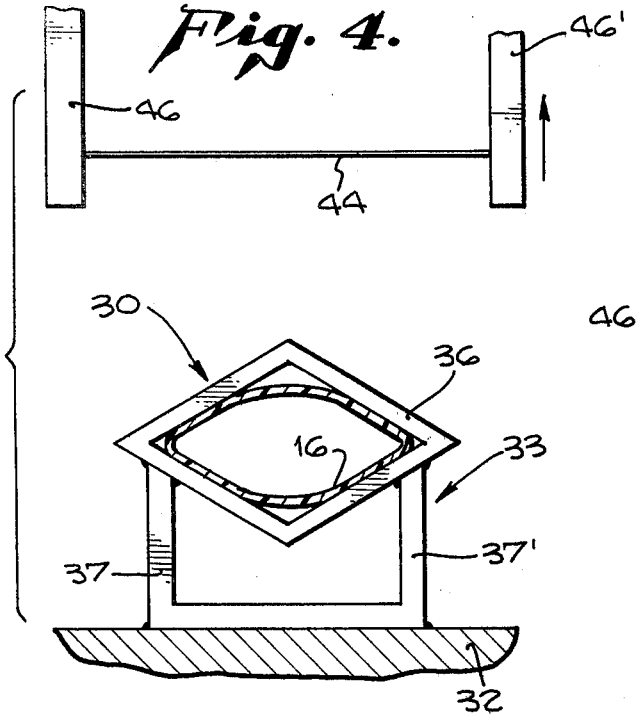
FIG. 4 is a view taken along the line 4—4 of FIG. 3.

After passing through the heating chamber 22, the material passes through a former 30, shown more in detail in FIG. 4. The former 30 is mounted on a raised secondary platform 32 which is over the platform 11 spaced by way of a support member 33. The former 30 includes forming frame 36 of optional diamond cross-sectional shape, as may be seen in FIG. 4, the frame being supported on legs 37 and 37'. As the stock material passes through the frame 36, the initially flat material is caused to open up, as shown in cross-section in FIG. 4. That is, the horizontal dimension between opposite points of the optionally diamond-shaped frame may be less than the transverse dimension of the flat tubular stock so that it is constrained to open, as shown in FIG. 4.

Just beyond the former 30 is the slitter mechanism 42. See FIG. 3. This component includes slitting wire 44, as may be seen in FIG. 4, carried by arms 46 and 46' which are carried on the stem 48 of a pneumatic cylinder 50 having pneumatic connections 51 and 52 which will be referred to again presently. The pneumatic cylinder may be supported from the heat sealing mechanism 60 by way of brackets 61 and 62.

Figure 6:
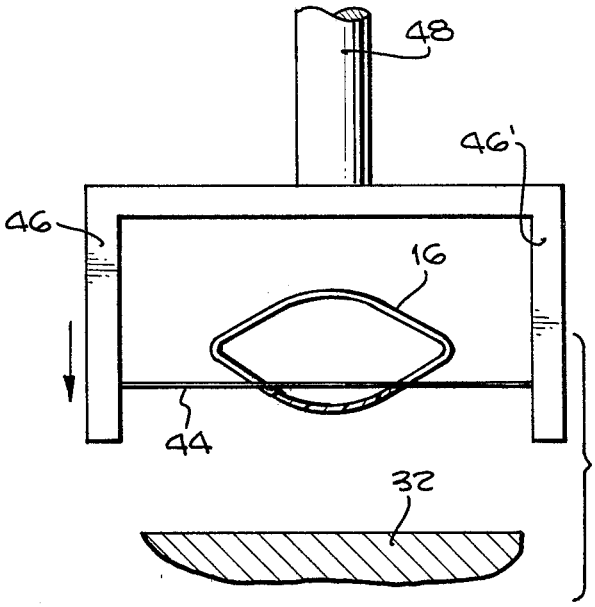
FIG. 6 is a sectional view taken along the line 6—6 of FIG. 5.
Figure 5:
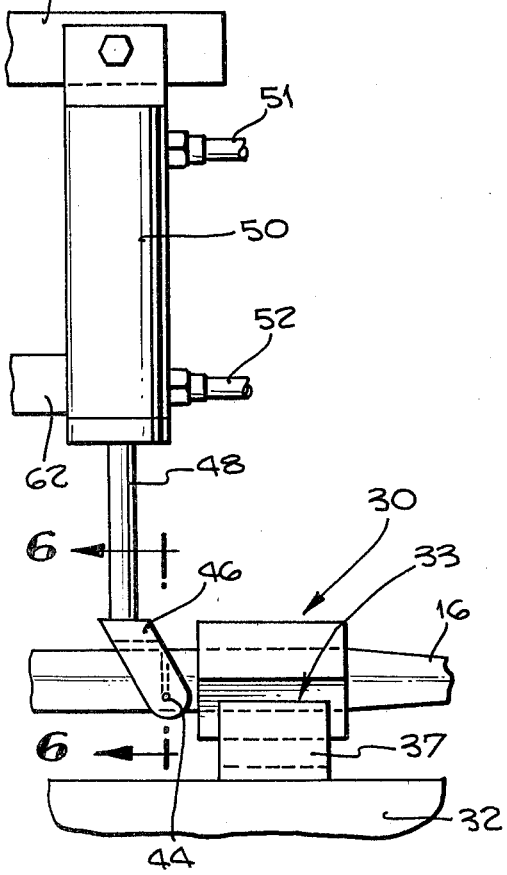
FIG. 5 is an enlarged view of the slitter mechanism.
Figure 7:
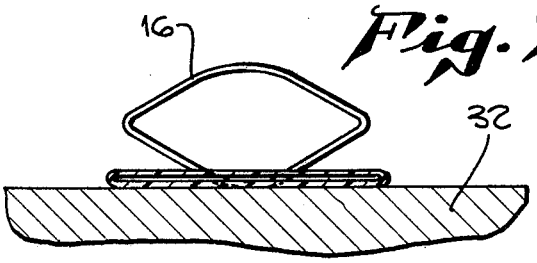
FIG. 7 is a view similar to that of FIG. 6 illustrating opening and slitting of the tubular material.

When the cylinder 50 is operated, the cutting wire 44 cuts part way through the open tubular material, as illustrated in FIGS. 5, 6, and 7.

Figure 1:
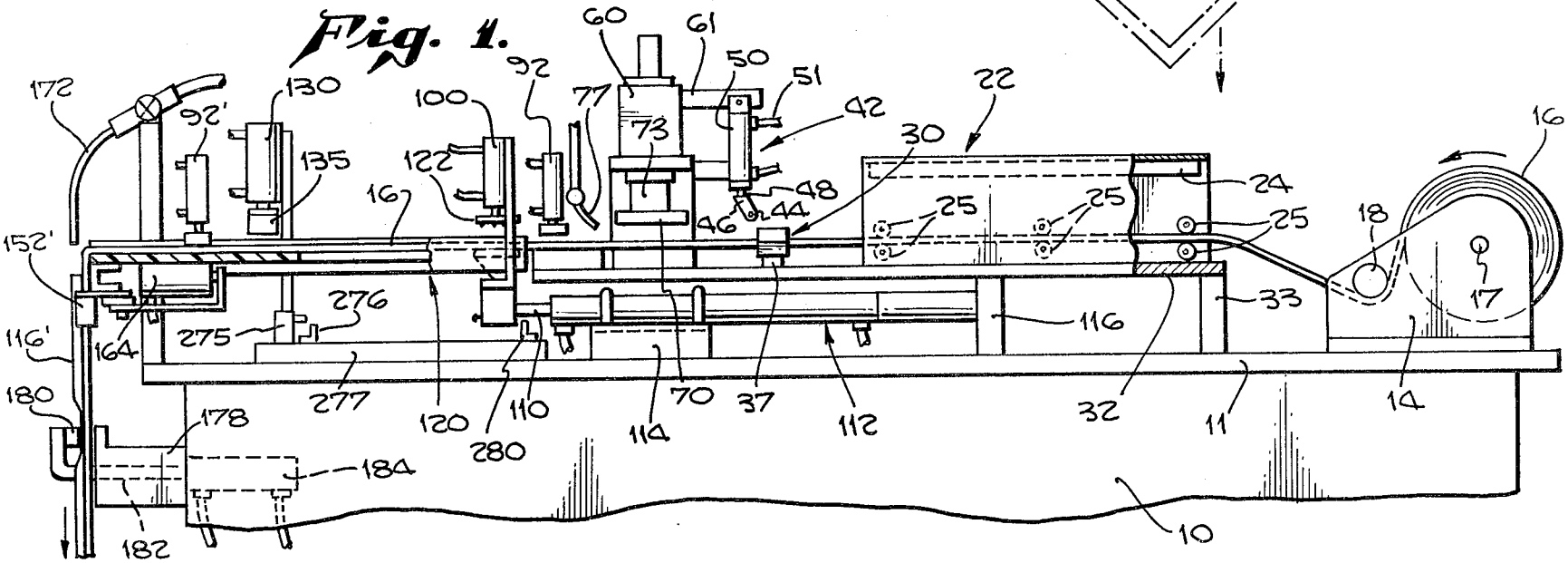
FIG. 1 is a partial schematic side view of the apparatus of the invention.
Figures 2, 3:
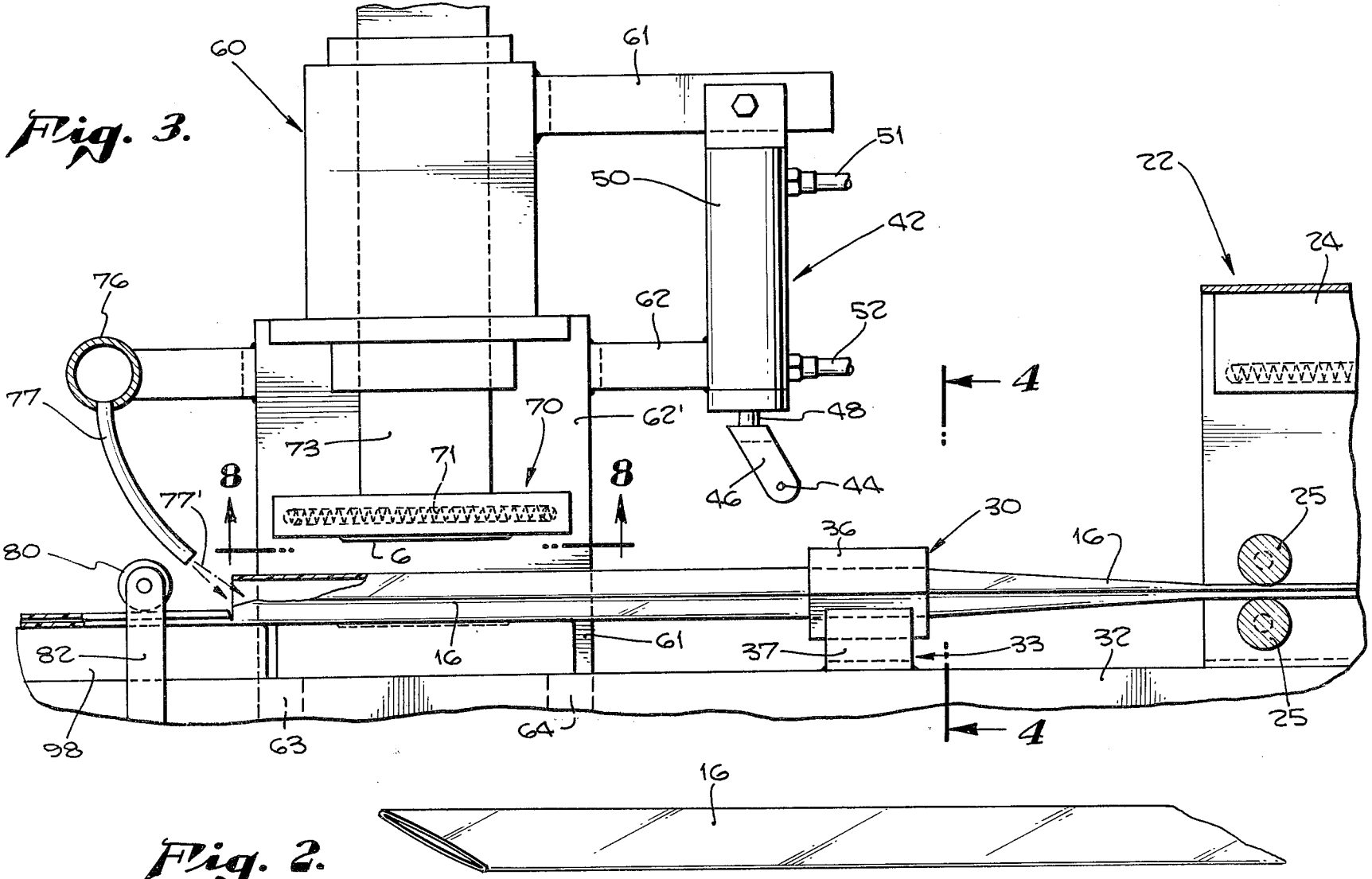
FIG. 2 is an isometric view of a section of the plastic stock tubing material.
FIG. 3 is a partial enlarged view of a central portion of the apparatus of FIG. 1.
Figure 9:
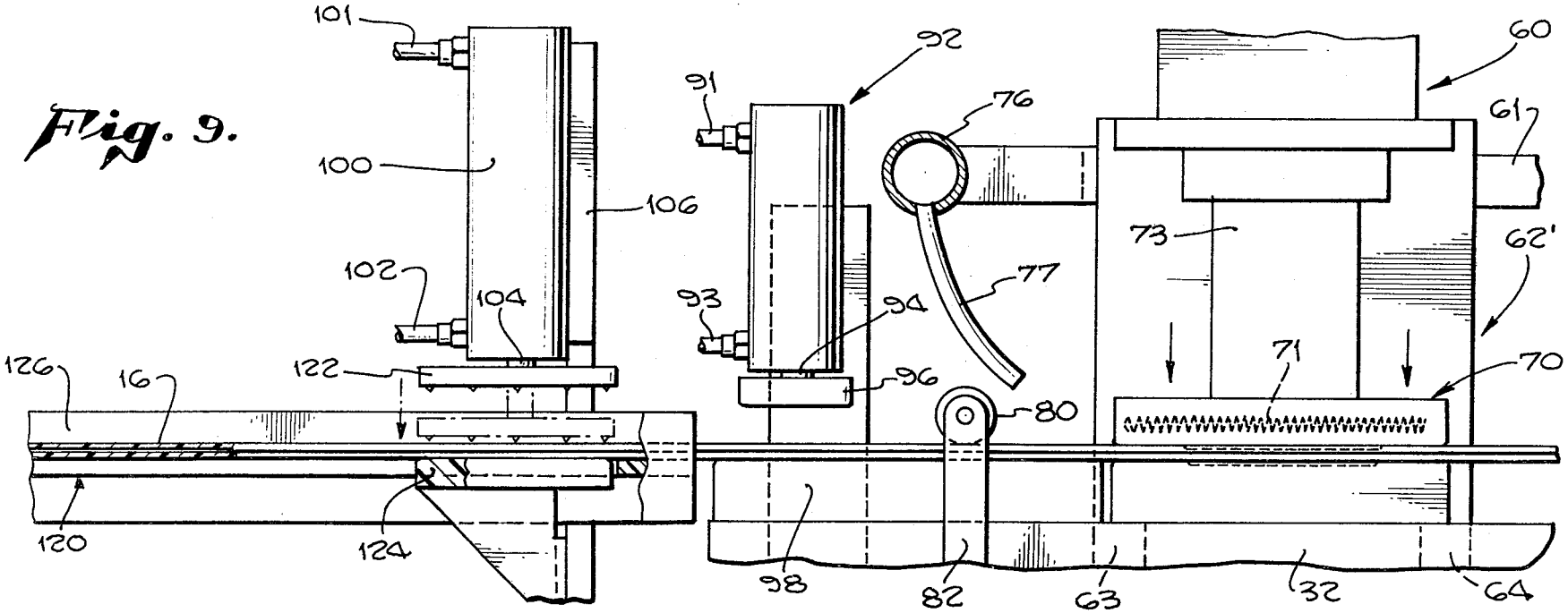
FIG. 9 is an enlarged partial view of a portion of the apparatus of FIGS. 1 and 3.

The heating sealing component is beyond the slitter, as illustrated in FIGS. 1, 3, and 9, and it embodies frame or housing 62' supported over platform 32 by way of support members or legs, such as shown at 63 and 64. The end of the slit tubing passes through the housing 62', as illustrated in FIG. 3. Within the housing 62' is an electrically heated die or platen, as designated at 70, this component embodying an electrical heating coil 71. The die is actuated by a pneumatic cylinder, as designated at 60, therein being a piston rod or column 73 actuated by energizing the pneumatic cylinder which carries the die or platen 70.

Numeral 76 designates an air line having a tubular connection 77, the end of which forms a nozzle positioned to blow air 77' into the end of the tublar material at the point at which it is slit to hold it open as illustrated in FIG. 3. Beyond the slit, the stock material passes under a roller 80 carried on a standard 82 so that the material is again in a flat condition during and after heat sealing. Preferably, the sealing die produces a heat seal of the shape as illustrated at 6 in FIG. 8 which is configurated to provide the discharge end closure of the flexible container being fabricated.

Beyond the heat sealing component 60 is a clamping mechanism for clamping the heat sealed tubular material, this mechanism including pneumatic cylinder 92, air connections 91 and 93, and having a stem 94 connected to a clamping head 96. When cylinder 92 is actuated as will be described hereinafter, the clamping 96 clamps and holds the heat sealed tubular stock material clamping it against backing member 98. See FIG. 9.

Figure 10:
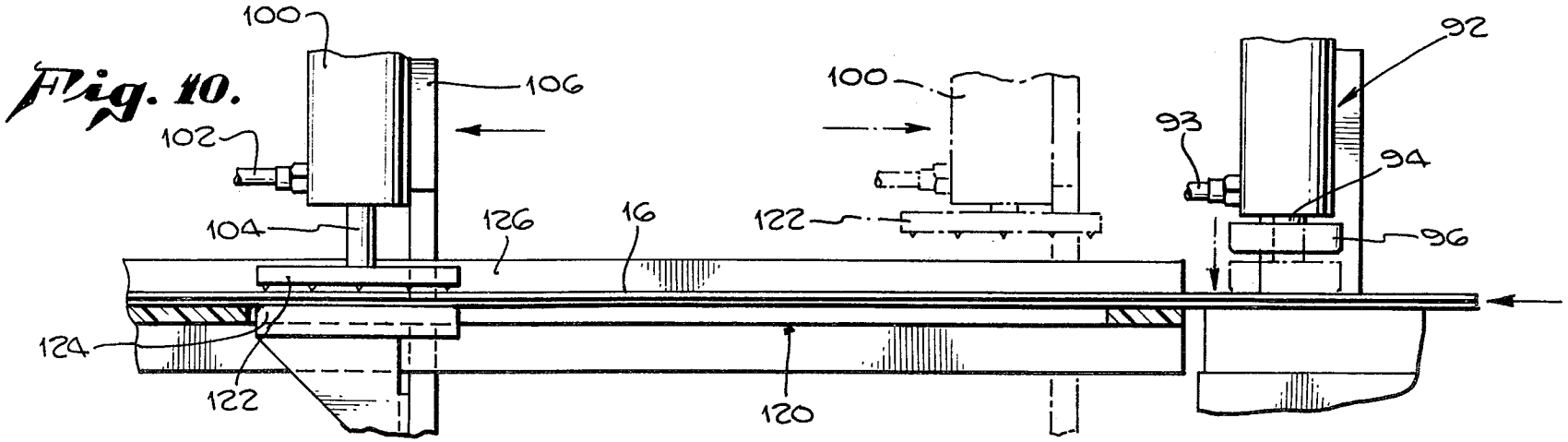
FIG. 10 is an illustrative view of the advancing mechanism of the apparatus.

FIG. 10 illustrates the operation of the clamping mechanism 92. Just beyond the clamping cylinder 92 is the mechanism for advancing the tubular stock material which is illustrated in FIGS. 1, 9, and 10. The advancing mechanism includes cylinder 100 having pneumatic connections 101 and 102 and stem 104. This cylinder is carried on an upright column 106 which is carried on the stem 110 of an advancing cylinder 11, as may be seen in FIG. 1. This cylinder is supported on a support 114 carried on platform 11 and further supporting member 116 between the raised platform 32 and the platform 11.

FIG. 10 illustrates the operation of the stock advancing material. The material is advanced along a platform as designated at 120, at a time when the clamping cylinder 92 releases and the cylinder 100, by way of its stem 104, actuates a toothed clamping head 122 which moves down and clamps the stock material against a sliding block 124 which slides in a Teflon lined guide track 126. The cylinder 100 and the sliding block then advance by actuation of the advancing cylinder 112.

The controls of the various cylinders, heaters, etc., will be described presently. Afer each advancement of the stock material, a new slit is made and another sealing operation is performed.

Figure 12:
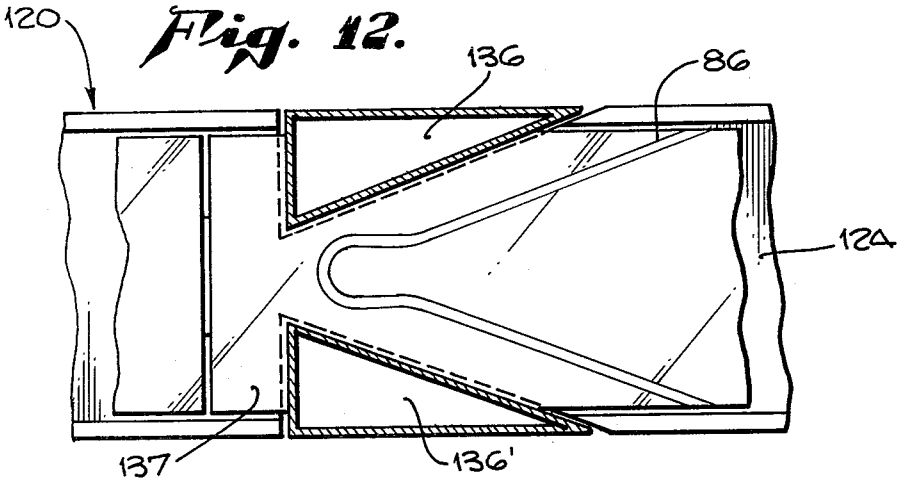
FIG. 12 is a view illustrating an optional notching operation after the heat sealing of an end part of the container.
Figure 8:
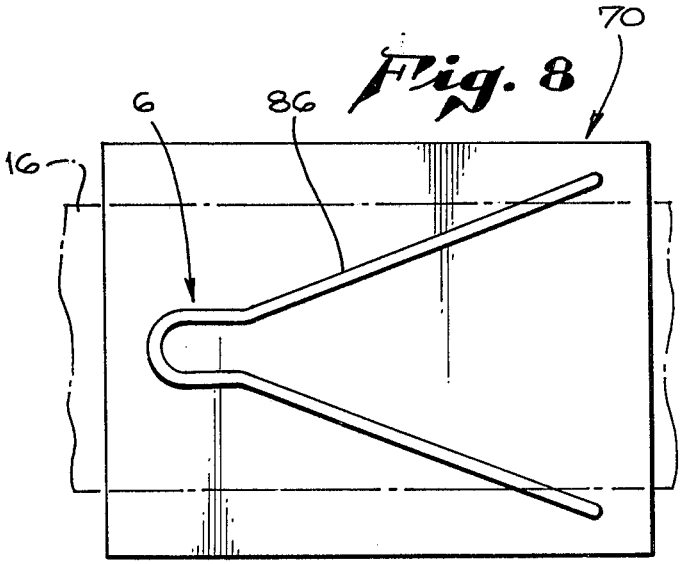
FIG. 8 is a view taken along the line 8—8 of FIG. 3.

A notching or cutting die is preferably combined with a sealing die 6, shown in FIGS. 8 and 12. The notching die or station includes a pneumatic cylinder 130 having pneumatic connections 131 and 132. It is supported as shown on the standard 133, the stem 134 of the cylinder being connected to a cutting head 135 having knife edges 136 and 137. When the cylinder 130 is actuated, the cutting head 135 moves down and cuts away sections 136–136' of the heat sealed end of the tubular container illustrated in FIG. 12. The cut-away portions are preferably triangular, as shown, being adjacent to the preferably rounded end of the heat sealed configuration 86 but spaced from the cut end so as to leave an end tab 137. This tab is cut off or otherwise removed to open the container.

Figure 11:
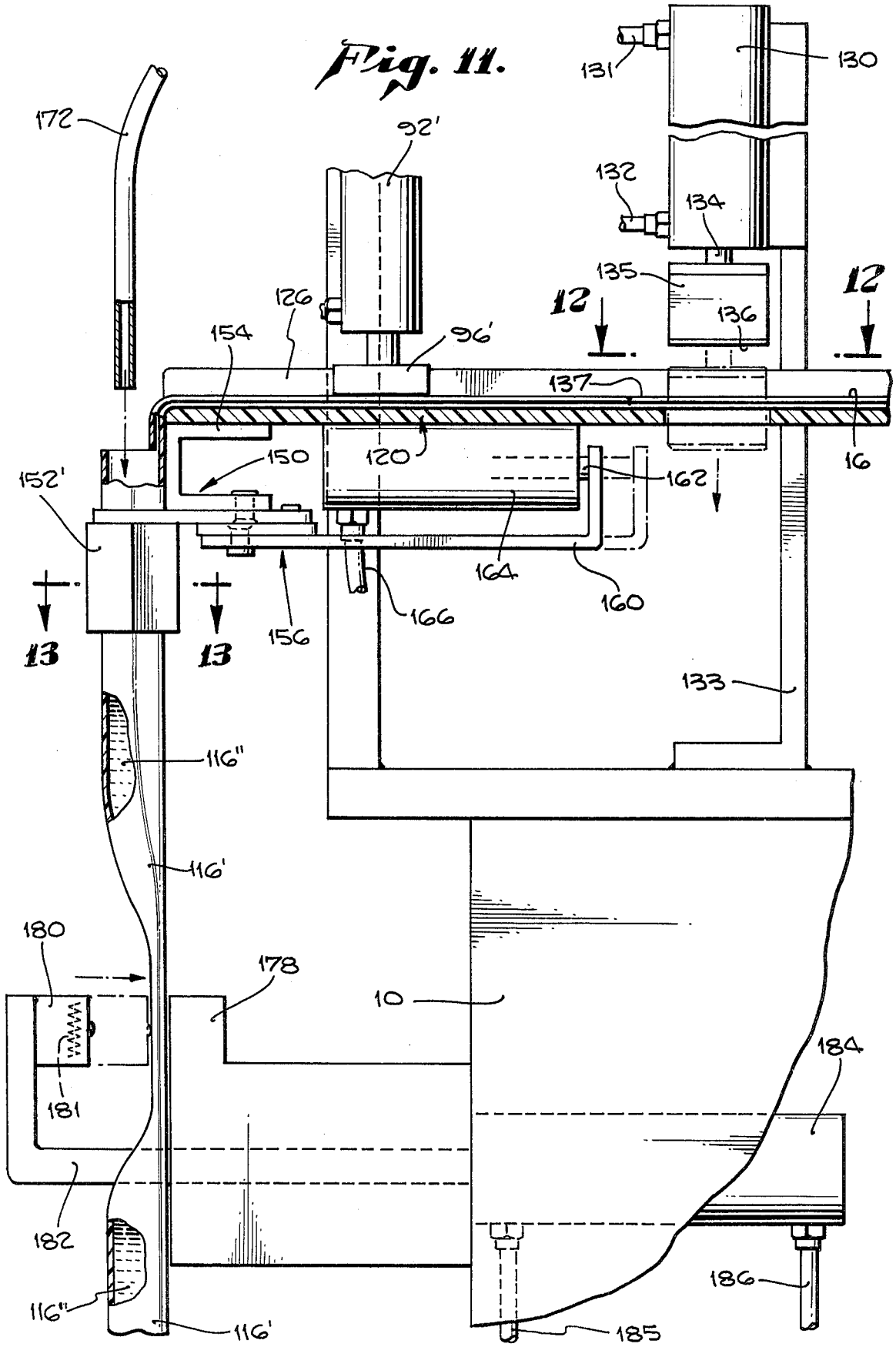
FIG. 11 is an enlarged view of a left hand end portion of the apparatus of FIG. 1.

FIG. 11 shows the components at the delivery end of the apparatus. The flattened and heat sealed tubular material passes the end of the platform 120 and moves downwardly as at a 90° angle, as shown in FIG. 11. Numeral 150 designates automated mechanism for opening the sealed tubular units at the opposite end. This mechanism includes a pair of right angle shoes 152 and 152', shown, e.g., in FIGS. 1 and 13, which are movable toward and away from each other so as to cause the tube to be opened when they move toward each other as shown in FIG. 13. Numeral 154 designates a U-shaped bracket carried by the platform 120 to which is attached a lever mechanism which is in the form of a scissors mechanism, as designated by numeral 156, this mechanism having levers attached to members 152 and 152' which are actuatable by arm 160 connected to the stem 162 of pneumatic cylinder 164 having pneumatic connection 166 being an "air push-spring" return piston, this cylinder and piston being carried underneath the platform 120.

Numeral 172 designates an air delivery pipe, the end of which is positioned, as shown, to be over the trapped and opened end of the tubular container for filling it with any type of material to be packaged which may be liquid, semi-liquid, or the like.

Below the mechanism 150–156 is an angle member 178, optionally associated with another heat sealing die 180 having in it an electric heater 181. This die is carried by a member 182 actuatable by the stem of another pneumatic cylinder 184 having pneumatic connections 185 and 186. As the filled tubular container moves downwardly in FIG. 11, the heat sealer 180 is actuated to clamp the tubular material between itself and the anvil 178 to produce a horizontal heat seal closing the end that becomes the bottom end of the completely fabricated sealed and closed container.

Figure 14:
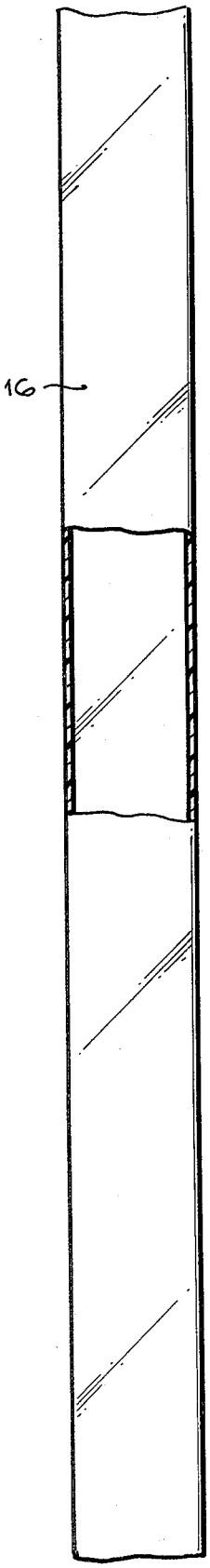
FIGS. 14–17 are illustrative views illustrating the progression in the fabrication of the container during successive stages of fabrication.
Figure 15:
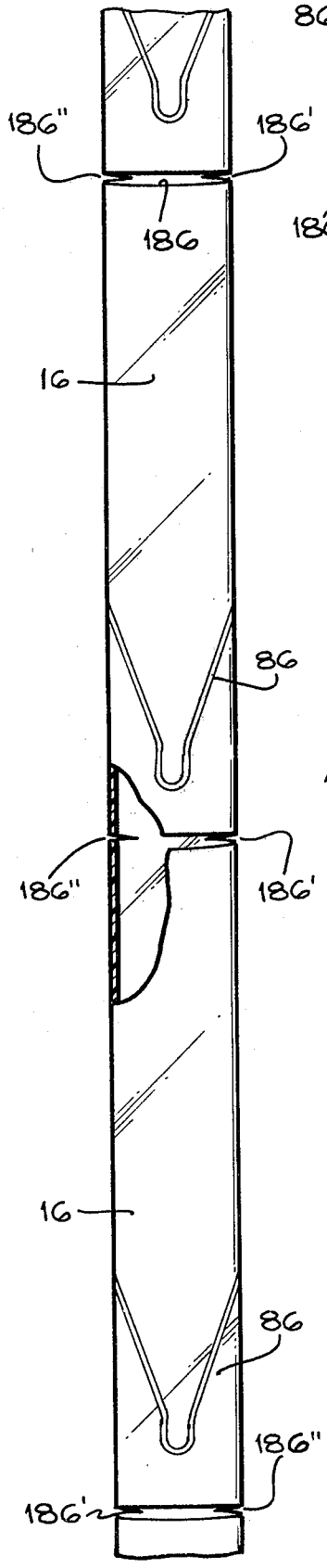

FIGS. 14–17 illustrate the tubular container at various stages or stations of the fabricating method and apparatus. FIG. 14 illustrates the plane tubing stock blank. FIG. 15 illustrates the stock with cuts made in it, 186, 186' and 186'' and with the heat seal made at 86.

Figure 16:
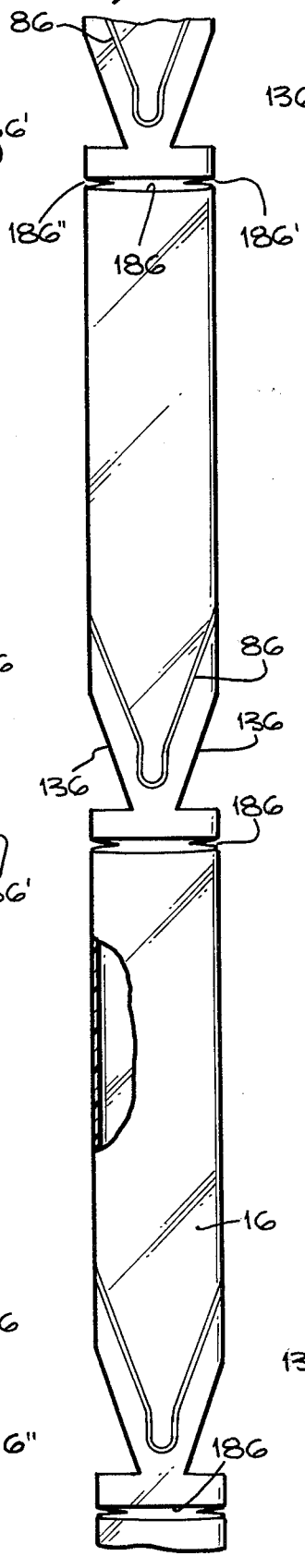

FIG. 16 illustrates the stock after processing by the notcher to cut out portions of the material adjacent to the heat sealed area as shown at 136 and 136'.

Figure 17:
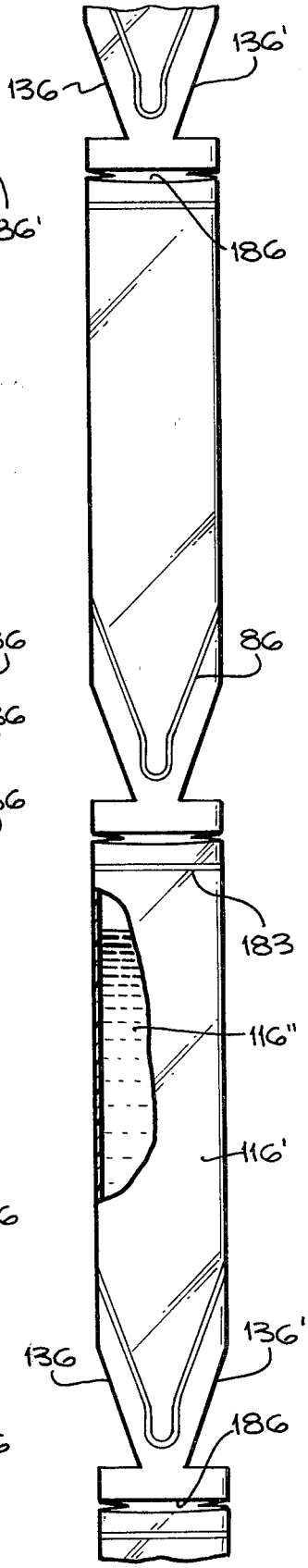

FIG. 17 illustrates the stock after the final heat sealing by the heat sealer 180 that closes the bottom end of the tubular container after having been filed, as shown at 183.

As previously described, all of the operations of the apparatus are fully automated under automatic control of pneumatic and electrical instrumentalities properly sequenced automatically so that the fabrication and filling of the containers are entirely automatic.

Figure 18:
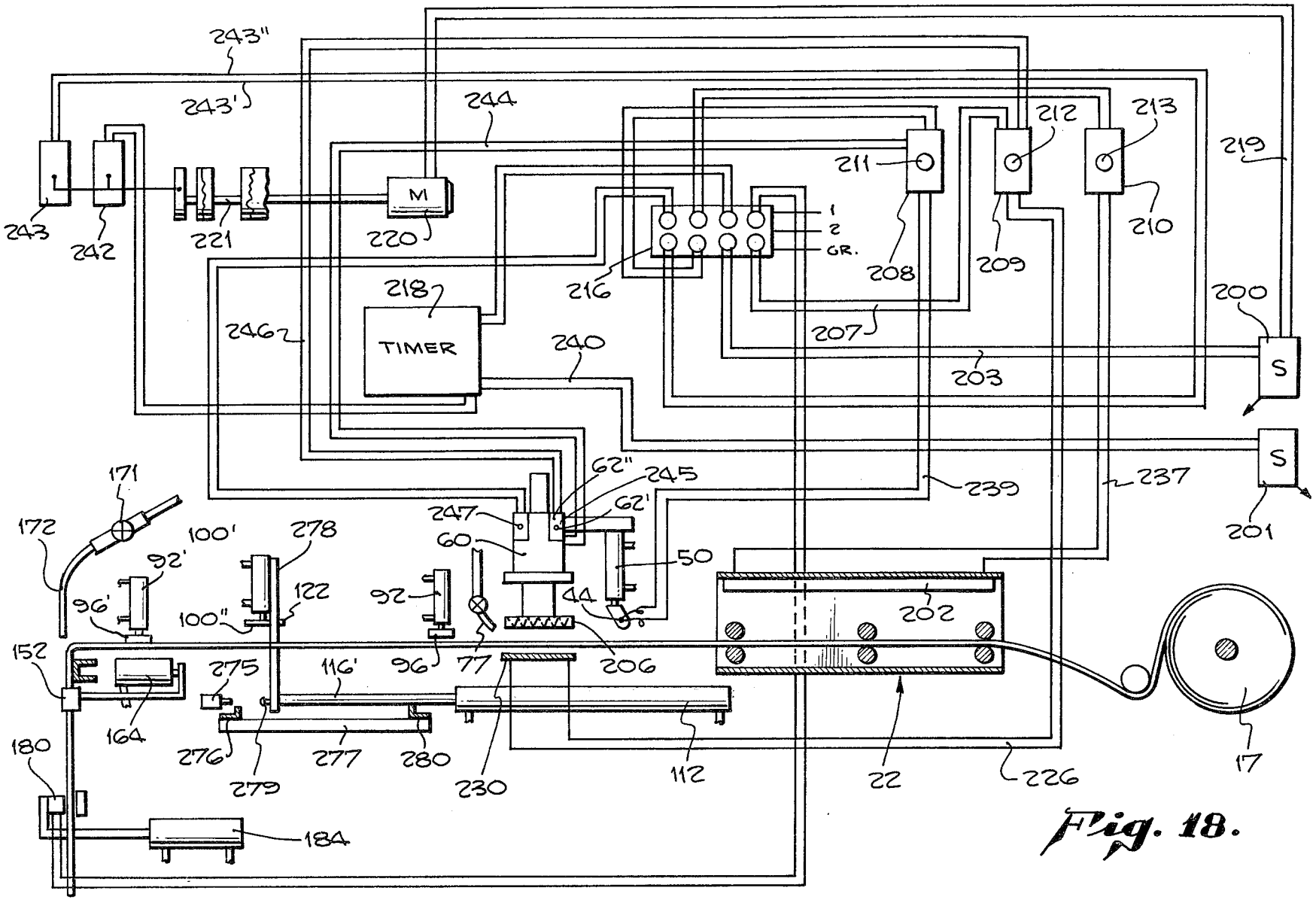
FIG. 18 is a circuit diagram illustrating the electrical controls for the apparatus.
Figure 19:
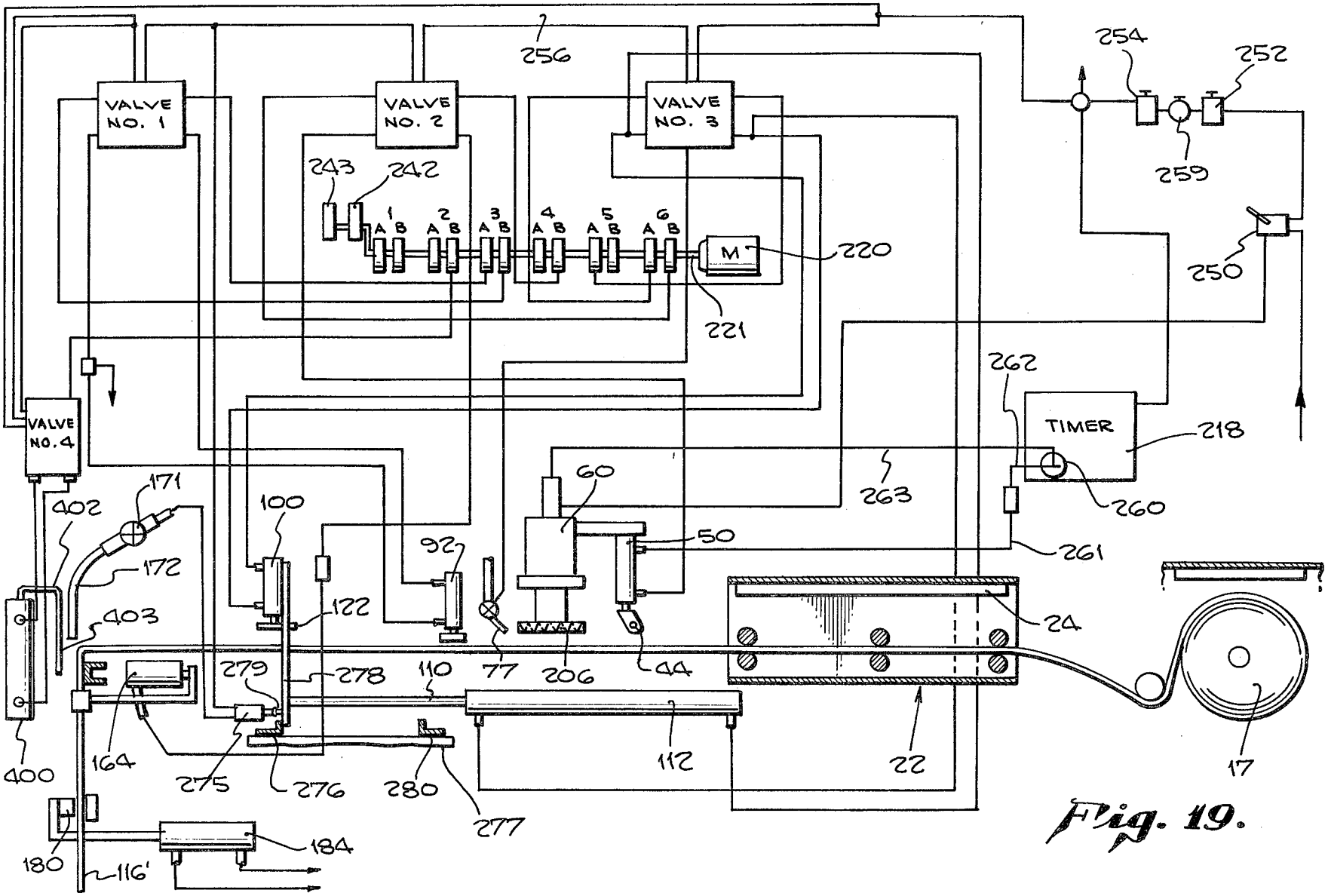
FIG. 19 is a circuit diagram illustrating the pneumatic controls for the apparatus.

The automatic controls are schematically illustrated in FIGS. 18 and 19, FIG. 18 illustrating the electric controls and FIG. 19 the pneumatic controls.

ELECTRICAL CONTROLS

The electrical components and the circuits, therefore, are shown in FIG. 18 and will be referred to first. In FIG. 18 at the right are shown switches 200 and 201, one of them being for purposes of initiating a cycle of operation manually and the other for initiating automatic operation.

Re FIG. 18, sealer No. 1 is a sentinel control similar to that of the Vertrod having its own pneumatic and electrical remote outlets. Heat sealer No. 2 may be a self-contained unit of the Vertrod type, manufactured by Vertrod Manufacturing Co. Having an electrical outlet, the remote part of the unit is interconnected with micro switch No. 1, normally closed, and is triggered by a lever that is attached to programmer cam 1A. Having its own timing device, it is synchronized with sentinel timer 218, so that sealers Nos. 1 and 2 heat seal simultaneously. The pneumatic port is interconnected to the main air line through a "T" connection intersecting at and with 256.

Numeral 202 designates the electrical heating element that is within the tunnel 22 that controls the heating to provide the desired consistency of the tubing material as it is being processed.

Numeral 44 illustrates the heater, that is, the slitter, which cuts the slit in the tubing material, as previously described.

Numeral 206 designates the heating element provided within the heat sealer unit 60.

The various heating units are controlled by transformers, preferably variacs 208, 209, and 210, each of which is provided with suitable timers and temperature control means adjustable by knobs 211, 212, and 213.

Numeral 216 designates the terminal box from which power is supplied to all of the various units, as will be described.

A timer is provided, as designated at 218, the timer controlling a pneumatic valve and a timing sequence, as will be described.

Numeral 220 designates a motor which drives a shaft 221 having on it cams that actuate drive mechanisms that control the pneumatic actuators of the system, as will be described presently, in connection with FIG. 18.

Referring to the circuitry, it will be noted that power is brought into the terminal box 216 through three lines, as shown. The terminals at the right end of the box 216 connect to the transformer 209, as shown, and to the heat sealer 180, as previously described. A circuit is shown at 226 from the transformer 209 to the heating element 230 which supplies auxiliary heat for sealing. Terminals at the box 216 connect to the automatic switch 200, as shown, and a further circuit extends to the timer 218, and other of the terminals of the terminal box 216 connect to the transformers 208 and 210, as shown. The terminals at the left of the terminal box 216 connect to the heater 206, in the heat sealer 60. The transformer 210 has a circuit 237 connecting to the heater 202 in tunnel 22, and the transformer 208 has a circuit 239 connecting to the heater 44 of the slitter. A circuit 219 extends from the motor 220 to the automatic operating switch 200. A circuit 240 extends from the manual switch 201 to the timer 218, and there is also a circuit from micro switch 242 to the timer 218 in 243' and 243" connecting with the remote control of Vertrode heat sealer No. 2. Microswitch 243 is connected to the terminal 216 through circuits 243' and 243".

Terminal box 216 consists of four duplex 3-wire U-grounding receptacles with outlet junctions. Leviton Cat. #5320, Leviton Corp.

Circuits 244 and 246 extend from transformers 208 and 209, respectively, to micro switches 245 and 247 within unit 62' and which are actuated thereby, as will be described, to energize slitter 44 and heat sealer No. 1, being element 230.

PNEUMATIC CONTROLS

The various components of the apparatus are shown in FIG. 19 with the pneumatic lines connecting with the pneumatic components. Pneumatic pressure is admitted to the system by way of a pressure gauge 259, moisture trap 252, and oil trap 254. Line 256 connects to four pneumatic valves identified as No. 1. No. 2, No. 3, and No. 4. These valves are of an automatic type which control the pneumatic actuators which are double-ended cylinders. In the actuation of these cylinders, pneumatic pressure is applied to one end and released from the other and then, for the opposite actuation, pressure is applied to the other end and released from the first end. The valves, Nos. 1, 2, 3, and 4, provide for this actuation. These are illustrated as conventional equipment and described in, e.g., Mead Catalogs, and are commercially available. Line 263 connects from timer 218 to cylinder 60.

The timer 218 has a time activated valve 260 unit which is connected by line 261 to the slitter actuator cylinder 50, this line having a branch line 262 that connects to the timer 218. Timer 218 consists of a three-way valve with "normally" open "exhaust" ports, a timer, relays, pressure regulator, and remote outlet receptacles for electrical and pneumatic connectors, e.g., manufactured by Packaging Industries of Montclair, N.J.

The motor is designated at 220. On its shaft 221 are a series of cams which control the valves Nos. 1, 2, 3, and 4. The cams are identified by the characters 1A, 1B, 2A, 2B, 3A, 3B, 4A, 4B, 5A, 5B, 6A, and 6B, as shown in FIG. 19.

The valve No. 1 has lines, as shown, and connecting to the actuating cylinder 92 of the clamping device. It also has lines, as shown, and leading to the valves actuated by cams 3A and 3B.

Valve No. 2 has a line leading to the slitter actuating the cylinder 50 and a line leading to the actuator 164, and lines leading to cams 4B and 6B.

Valve No. 3 has a pair of lines leading to the actuating cylinder 100 of the advancer. It also has lines, as shown, connecting to the actuating cylinder 112 of the advancer. Valve No. 3 also has lines leading to the cam 6A and 5A and to nozzle 77.

ANOTHER PREFERRED EMBODIMENT

Figure 21:
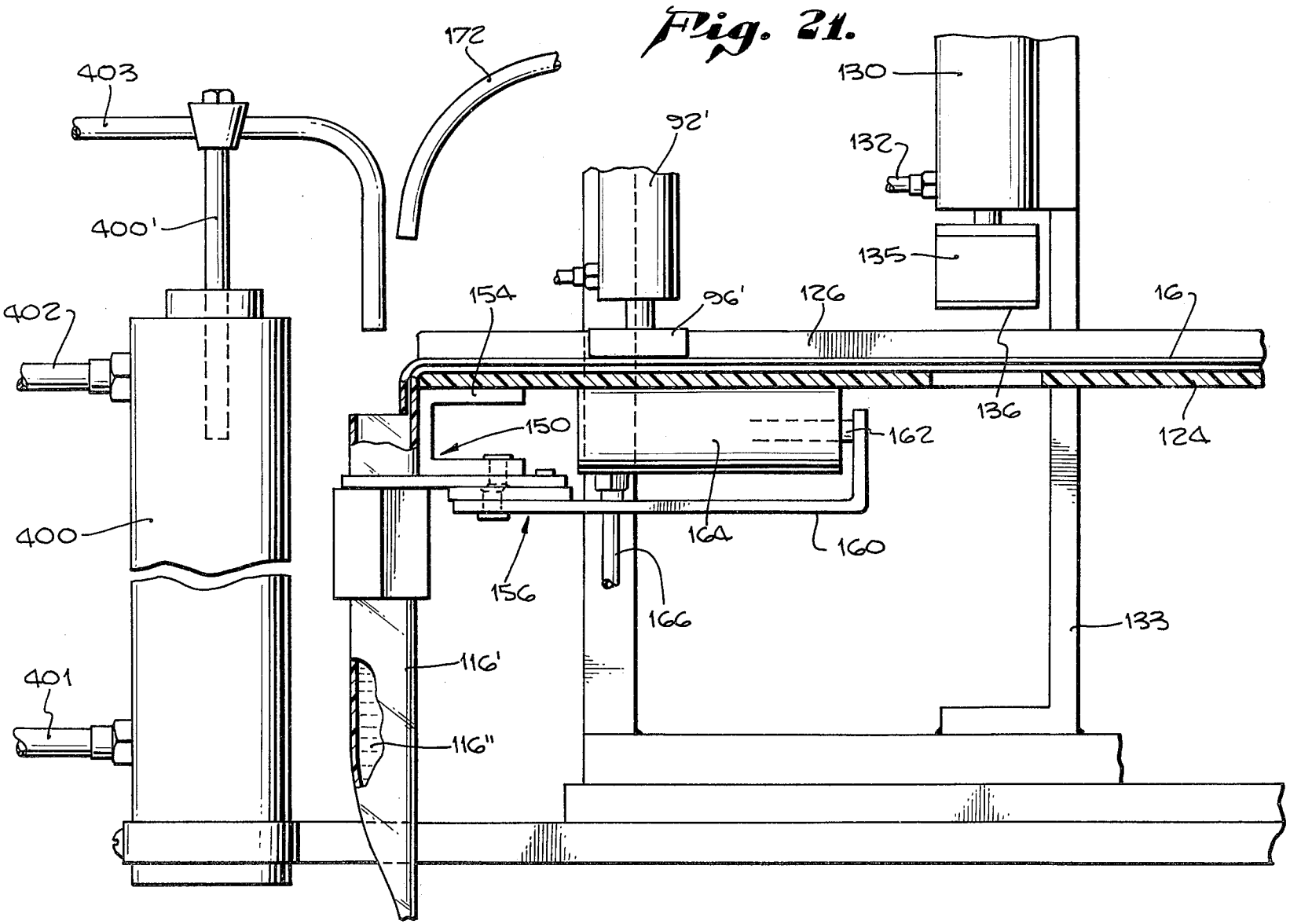
FIG. 21 is a preferred form of filling apparatus associated with the left hand side of the machine as it is illustrated in FIG. 1.

At the left hand side of the machine, as illustrated in FIG. 1, in lieu of the filling and sealing mechanism therein illustrated, another preferred embodiment of the filler and sealer mechanism is illustrated in FIGS. 19 and 21.

Therein, a valve No. 4 is expected to be opened at a predetermined position coinciding with the exposure of the tube at the left hand end of the machine of FIG. 1 in the filling position thereof. A three-way actuator valve 275 is controlled by an adjustable stop 276 positioned along a portion 277 of the bed 11 of the machine, such that upon extension of the rod 112' toward the left, as illustrated in FIG. 18, the arm 278 of the filler 100 carried on the piston 112' engaging the adjustable stop 276 by means of an adjusting screw and engagement element 279 carried on the end of the piston 112. Upon such engagement of the adjustable stop 276 by the screw 279, a three-way actuator 275 is struck and opened, sending an impulse through the valve No. 4, thus directing a jet of air through the valve 171 and tube 172. The said jet of air is directed into the open end of the tube 116', hereinafter described, as at the left hand end of the machine, as illustrated in FIG. 1, having dropped into that position preparatory to being filled and sealed, as stated. Upon the return stroke (to the right, as illustrated in FIG. 18) of the piston 112' upon 278 carried therewith or some other suitable engaging mechanism similarly engages but in a reverse direction the adjustable stop 280 which limits the movement of the holddown piston with its associated pad (piston) 100', preferably carrying a non-skid or roughened lower surface 100'' to engage the tubing 16 and assist its advance intermittently between strokes of the piston 112' for predetermined distances depending upon the desired length of the final tube or segment, i.e., as measured between the limits of the stop 280 on the right hand side, shown in FIG. 18, and the stop 276 on the left hand side.

As hereinmentioned, the additional weight of the filled tube also assists, if desired, to move the tubing along the machine.

Said valve No. 4 is preferably a three-way Mead valve, normally closed to operate a cylinder that is used in conjunction with the filling machine located to the left of the air jet nozzle (FIGS. 1, 11, 18, and 19).

An air cylinder 400 provides an in and out motion directly into the open end of the tube 116' during the dispensing of the tube contents, e.g., cream, liquid, and the like.

The cylinder 400 is operated by a cam 2B and triggered by a ball actuator corresponding thereto. The length of time that the cylinder 400 is kept open is determined by extending the length of the lobe of the cam 2B and controlling the pressure of the airflow through an airflow valve 401 associated with said cylinder 400.

A jet of air from valve 275 is initiated by the striking of the three-way versa valve 275 attached to the left of anvil 276. The valve is normally closed and opens when struck by adjustment screw 279 (FIG. 19).

This other preferred filling and sealing means illustrated in FIGS. 19A and 20 comprises cylinders 300 and 301 mounted on opposite sides of the center of the machine illustrated in FIG. 1 but at the left hand end thereof in lieu of the filling and sealing mechanism illustrated in said FIG. 1.

The cylinders support and drive anvils 302 and 303, respectively. Said anvils are shown in relatively open position, separated from one another in FIG. 20 but, in FIG. 19A, are shown in relatively closed position proximate to the tubing 16. The anvils 302 and 303 press together a suitable sealing means, such as a heated nichrome band or wire 304 in portions 305 and 306 in opposed relation to one another so that upon being brought to bear and in pinching relationship to the tubing 16, as illustrated in FIG. 19A, a heat seal can be effectuated upon the electrical heating of the nichrome bands or wires in a conventional manner.

Immediately prior to such sealing operation, as illustrated in FIG. 19A and referred to hereinabove, the partly severed or slit tubing 16, having been partically cut through at station 30 (see FIG. 1), then hingedly falls over the left hand end of the machine, as illustrated in said FIG. 1, where it is then engaged by the angle shoes 152 and 152' (see FIG. 13) and squeezed into an open position for the more facile introduction of the liquid or other material intended to be contained in the tube. In such open posture as illustrated in FIG. 19 and also FIG. 13, the tube is filled to a desired level up to but preferably below the station illustrated most clearly in FIG. 19A where the closing or back seal is effected, preferably, as stated, above the level of the liquid with which the tube has been filled.

The position of the anvils and the transverse direction of the seal is optionally in the plane of, and parallel to, the seal illustrated in FIG. 7, for example, at the opposite end of the tube, or alternatively, in the direction illustrated in FIG. 19A which would be at right angles to said plane of the opposite end of the tube.

The cylinders 300 and 301 are actuated through air lines 310 and 311 with respect to cylinder 300 and through air lines 312 and 313 with respect to cylinder 301. Air line 314 connected to a sentinel control valve of known design and air line 315 communicate, as illustrated with valve 1. These air lines, valves, and cylinders are synchronized so that the cylinders 300 and 301 are actuated to compress the tubing and seal the same following the placing of the tube for filling heretofore described and illustrated in FIGS. 13 and 19, to provide a continuous but intermittent filling and sealing operation, also including therewith an optional cutoff for the tubes. Preferably, however, it is desired to have some downward pull on the tubes over the left hand end of the machine, as illustrated in FIG. 1, to achieve a smooth filling operation and to provide a definite stage or stopping station for the tubing passing through the machine. Thus, gravity assists the pulling of the tubing in the last stage of filling and sealing and drawing the tubing over the left hand end of the machine for the operation of opening the tubing for filling, preferably simultaneously, or at least synchronously, with the preceding operations of slitting and sealing the respective ends of each tubular segment.

In FIG. 19 at the left hand side thereof and in larger detail in FIG. 21, there are illustrated a filling and mechanism associated with valve No. 4, heretofore described and to which is connected air lines 401 and 402. A filling tube suitably mounted for vertical reciprocation 403' is mounted on the stem 400' of the cylinder 400 and is synchronized into the valve No. 4 and its associated mechanism, hereinabove described and illustrated, through the air lines 401 and 402 to alternately raise and lower so that the end of the filling tube 3 extends downwardly to a desired extent into the opened end of the tube 116' to fill the same with the liquid 116'' or the like viscous material.

Having reference to FIG. 20, there has been illustrated and described opposing cylinders 300 and 301 carrying anvils 302 and 303, respectively, in opposed relationship and, in turn, carrying elements of a nichrome band or wire 304 with sealing portions 305 and 306. Said nichrome wire circuit is connected in parallel with heat sealer No. 2.

The cylinders are operated preferably by air through lines 310, 311, 312, 313, and 314, leading to the sentinel control box 260 of FIG. 19. By this means, the tube 16, then being filled and held by the formers 152 and 152' (see FIG. 13) is sealed above said formers by the nichromes 304, 305, and 306, the seal being accomplished between the portions 305 and 306 which are disposed on opposite sides in the final stage of sealing of the tube, as illustrated more clearly in FIG. 19A.

As also shown in FIG. 19A, the nichrome sealing elements 305 and 306 are more closely juxtaposed against the tube 16 for sealing the same.

In order to more clearly illustrate the operation of the machine heretofore described, the same is treated first in a single cycle operation and thereafter in the manner of an automatic operation, each by way of "operating instructions".

OPERATING INSTRUCTIONS

To "Single Cycle" the Machine

1. Tubing should be laced through all stations with pneumatic cylinders in "off" position (air disconnected completely).

2. Make sure all electrical component switches are in "on" position. Red lights should appear on the following:

- Variac 210 for tunnel—set pointer of dial approximately 60° to 80° on range control, in FIG. 18;
- Variac 209 controls heat of nozzle sealer No. 1. Set pointer of dial at approximately 5 seconds on range control, FIG. 18;
- Closing sealers (heat sealer No. 2) set approximately 6 to 8 seconds (hold time), (heat range approximately 6 to 8 seconds;
- No. 2 heat sealer is the Vertrod sealer, as described in FIG. 18 of its description;
- Main timer (the sentinel) clock of No. 218 to be set 6 to 8 seconds;
- Transformer of slitter heat range and time delay should be set on dial at 5—No. 211 of No. 208, in FIG. 18.

3. Connect air line with pressure gauge set at 75 to 80 pounds of pressure on gauge 259;

Push manual three-way valve in FIG. 19, No. 250, to the left and downward—air returns all cylinders to respective positions.

Slitter 50 should be up. Sealer No. 1 should be up. Hold down in FIG. 19, No. 92, should be clamping material. Advance cylinder 112 should be at return stop of anvil (to the right side). Advance clamp hold down in FIG. 19, No. 92, will be in an "up" position.

Hold down No. 92', FIG. 19, will be in "down" position (clamping material). Nos. 152 and 152', mandrels that hold tube open prior to and during filling, will be in a closed position. Sealers Nos. 302 and 303. Both jaws or anvils are open. Filler inserting tube attached to cylinder, No. 400 (FIGS. 19 and 21) will be in an "up" position.

Return hand lever to an upright position.

Pressing single cycle single pole momentary—normally off button switch, No. 201.

Slitter wire No. 44 attached to piston shaft of cylinder No. 50 comes down Sealer No. 1 (FIG. 18), No. 230, will seal; end sealer No. 2 (FIG. 19A), Nos. 305 and 306, will seal.

Note: Cylinders remain closed even after time delay has elapsed. Electrical phase of heat sealing is controlled by triggering of the microswitch 62''.

To return cylinders to their respective position, air lever (FIG. 19), No. 250, must be pushed to the left and downward note cylinders will return to starting position.

Return lever (FIG. 19), No. 250, to its upright position. To repeat single sealing sequence, press button No. 201.

AUTOMATIC CYCLE

Before pressing the automatic toggle switch, No. 200, the position of the tube is such that it has been properly laced in the machine, and all electrical components show their red lights are on—

From right to left, facing the front of the machine, the cylinders are in the described position. The tubing is gradually being heated in the tunnel. Next, the tubing is being held open by the former guide, No. 36, in FIG. 4. Slitter cylinder No. 50 holding slitting wire No. 44 is up. Cylinder No. 60 is in an "up" position. Air jet under cylinder No. 60 is off. Hold down cylinder No. 92 with pad No. 96 is clamping down on the tubing. Advance cylinder No. 112 is back against adjustment stop 280. Advancing cylinder clamp 100 with pad No. 122 attached is up. Versa valve No. 275, just to the left of adjustment stop 276, is closed. The end sealing cylinders, Nos. 300 and 301, with anvils 302 and 303 are open. Former No. 2 with jaws 152 and 152' are closed. The dispensing filler tube cylinder is up, No.

Note: Slitting wire (44), heat sealer No. 1 (60), and sealer No. 2, and cylinders, Nos. 300 and 301, with bands attached (Nos. 305 and 306) are not energized at this time.

Turn toggle switch 201 to an "on" position.

Lever attached to cam of 1A triggers micro switches Nos. 1 and 2. Micro switch No. 1, connected to the remote control circuit of the Vertrod heat sealer No. 2, was energized, causing the electrical circuit to heat the sealing bands Nos. 305 and 306, as shown in drawing. At the same time, the pneumatic valve (normally closed) was opened so that it caused cylinders Nos. 301 and 302 to close, thereupon making a heat seal at the end of the tube.

Micro switch No. 2, connected to the remote control circuit of the sentinel control panel, was energized, causing the pneumatic valve (normally closed) to open air lines No. 261 intersecting at No. 260 of timer 218, and the in-ports of cylinders Nos. 50 (slitter) and 60 (heat sealer No. 1) slitting the tube and sealing nozzle shape on the down stroke of the cylinders.

On the down stroke of cylinders Nos. 50 and 60, the micro switch No. 62'' which was held closed by the lever attached to the piston rod of cylinder No. 60 releases a spring. This triggering action opens electrical circuit to energize Variac 208, causing it to heat the nichrome wire of the slitter No. 44. The Variac No. 209 which is also attached to this micro switch 62'' is also energized, in turn heating the wire attached to the heat sealer No. 1, causing it to seal the shape of the nozzle.

Sealing was present at approximately 6 seconds on both sealing dies.

Upon the elapsed time of sealing, the electrical heaters shut off at the slitter station and at heat sealers Nos. 1 and 2.

Programmer continues to turn upon which cam 4B triggers actuator 2B of valve No. 2 cylinder port B, feeding a momentary pilot pressure into chamber check valve PTV 314 (as described in sketch of pneumatic components); also the up strokes of slitter cylinder No. 50 port (52) and cylinder No. 60, heat sealer No. 1, and cylinder 164 having jaws 152 and 152' opened.

Note: During the switching of valve No. 2 cylinder port C to cylinder port B, there is an exhaust pressure unbalanced momentarily, causing the cylinder spring off 164 to overcome the lower pressure change, cylinder 164 returns to a normally open position (air push spring retactable rod). The air from the PTV valve cylinder port slowly exhausts its air (pre set exhausting time delay) into the sealing area below the sealing die 206.

The exhaust port of valve No. 3 on this sequence is exhausting this air and is connected to air jet 76 through tube No. 77. Air is directed into open end of the unsealed portion of the tube that was slit, having a ballooning effect into the tube while cooling the advancing tube at the same time.

Cam 3A triggers actuator 1B of valve No. 1, controlling up stroke of hold down cylinders 92 and 92' and opens former No. 2 anvils to cylinder of sealing unit No. 2 No. 305–306.

Cam 5A triggers actuator B of valve No. 3 cylinder port B open. The pad No. 122 connected to cylinder 100 applies pressure on the lower pad, gripping and holding the tube at the same time.

The advancing cylinder piston 116 of cylinder 112 advances forward and to the left, stopping at the predetermined stop set by the placed anvil on the left, No. 276. At this point, the adjustment screw No. 279 strikes the versa valve (normally closed) No. 275, causing it to open, sending out a jet of air directed into the open end of the container helping to inflate same in a ballooning like manner as it makes a 90° angle bend over the end (or edge) of the machine.

Cam 6A triggers actuator A of valve No. 3 cylinder port C open, reversing piston rod 116 cylinder No. 112. At the same time, the pad No. 122 of cylinder No. 100 attached to rod 104 retracts releasing its grip on the tubing and remains up returning to the reverse anvil stop to the right hand side No. 280. The versa air valve upon retraction of adjustment screw No. 297 closes.

Cam 3B tripping actuator 1A of valve No. 1 to control down stroke of hold down cylinder Nos. 92 and 92'—Note: Hold down 92' is air push-spring retractable rod type cylinder.

Cam 6B triggers actuator A of valve No. 2 cylinder port C open, pressurizing cylinder 164 closing former No. 2 jaws Nos. 152 and 152'. They remain closed, until activated by actuator 2B of cam 4B.

Cam 2B triggers actuator A (normally open) port of valve No. 4; stroke is fast going down, slow to return. Speed of the piston rod is controlled by extending the length of the cam lobe to keep it open, upon release of contact with cam, rod return is controlled with an airflow control regulator.

This invention features the provision of machinary and methods for the transport of flattened, collapsible tubing from a roll through a series of operations including passing the same through an optional heating stage for relaxing the tubing—for a period of time and at a temperature suited to the particular plastic comprising the tubing—and then through first squeezing rollers or formers which initially expands and opens the tubing and slitting the tubing in said opened posture, thence optionally further expanding the same as by blowing of heated air therethrough, then transporting the same to a position for heat sealing a self-closing end, then transporting the same to a station forming an angular run with respect to the axial direction first run, and providing methods for opening the tube at said new run, said new run exposing the tubing segments defined by the slitting operation and forcing said tubing to an open posture by means of other forming and holding means, then filling the respective tube segments and then sealing the filled tube, optionally, using the weight of the filled tube segment or segments to assist the progress of the tubing through the machine, and also, optionally, applying the second seal in a plane normal to the plane of the first seal.

Though a particular embodiment of the invention has been depicted and described above, the invention is defined solely by the appended claims interpreted in light of the specification.

I claim:

1. A machine comprising an elongated frame, means for transporting a length of tubing longitudinally thereover, the tubing being standard round tubing rolled flat, means for distending the tubing for slitting by blowing air into a slit already made, means for partially slitting the tubing at predetermined spaced positions in said distended posture to provide sections of tubing, means outside of the tubing to hold it distended adjacent the slitting means, means for applying a predetermined seal adjacent a slit in the tubing at the end of a section including means for retaining the opposite sides of the tubing in closely contiguous and proximate relationship and means for sealing portions of the tubing adjacent to said slit to provide an openable closure, means for advancing the tubing in incremental steps, means for opening a tube portion at a slit at the opposite end of said section, means for filling said tube portion from said opposite end and means for sealing said tube portion adjacent said last mentioned slit.

2. The method of forming a self-closable tubular container comprising transporting a length of tubing relative to a surface, the tubing being standard round tubing rolled flat cutting spaced slits partially therethrough, expanding said tubing by flowing air into a slit in the tubing holding the tubing expanded while cutting slits, forming a self-closable and manually openable seal thereto adjacent to a slit advancing the tubing in incremental steps, causing discrete portions of said tube to descend gravitationally in a generally vertical direction, causing a tube segment adjacent said seal to expand in condition of filling, filling said tube segment to a predetermined extent, and transversely sealing said tube segment at a location above its filled level adjacent a slit and trimming the resulting tube segment thereby producing a unitary filled tube having a manually openable closure at one end.

3. The method of claim 2, including the step of opening said tube by its angular change of direction sufficiently to permit filling the tube while so dependent and filling and sealing the same in said dependent condition.

4. In the method of claim 2, the improvement including forming an unslit hinge-like portion to open the tube segment at the slit while bending the tube length to expose and open the tube segment at the slit.

5. The machine as in claim 1 having means for retaining a length of collapsible tubing in collapsed rolled condition, said means for opening the tubing comprising juxtaposed rollers having concaved surfaces confronting one another through which the tubing is trained and squeezed open from its flattened earlier condition.

6. A machine as in claim 1 including mechanism for advancing the length of tubing intermittently in increments corresponding to said sections and mechanism for intermittently operating said slitting means and seal applying means in timed relationship to the advancing of the tubing.

7. A machine as in claim 1 wherein said seal applying means is constructed to provide a seal of a type which will open on the application of pressure to the tube and will automatically close.

8. A machine as in claim 1 wherein the said seal applying means includes a pair of anvils positioned to engage opposite sides of the tubing, heat applying means in a position between the anvils to engage the said tubing to provide heat sealing to form the said predetermined seal.

9. A machine as in claim 1 including pneumatically driven devices for advancing the tubing, for operating the slitting means; and for operating the seal applying means in timed relationship and automatic mechanism producing automatic cycling of the pneumatically driven devices.

10. A machine as in claim 9 including electric means for providing power for the said slitting means and seal applying means and for cycling the said electrical means in sequence with the pneumatically driven devices.

* * * * *